US011362404B2

(12) United States Patent
Putti et al.

(10) Patent No.: US 11,362,404 B2
(45) Date of Patent: Jun. 14, 2022

(54) MICROWAVE WINDOW INCLUDING FIRST AND SECOND PLATES WITH VERTICAL STEPPED AREAS CONFIGURED FOR PRESSURE SEALING A DIELECTRIC PLATE BETWEEN THE FIRST AND SECOND PLATES

(71) Applicant: Applied Materials, Inc., Santa Clara, CA (US)

(72) Inventors: Rajesh Kumar Putti, Singapore (SG); Prashant Agarwal, Bangalore (IN); Ananthkrishna Jupudi, Singapore (SG)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 17/084,804

(22) Filed: Oct. 30, 2020

(65) Prior Publication Data

US 2022/0140456 A1 May 5, 2022

(51) Int. Cl.
*H01P 1/08* (2006.01)
*H01P 1/04* (2006.01)

(52) U.S. Cl.
CPC ..... *H01P 1/08* (2013.01); *H01P 1/042* (2013.01)

(58) Field of Classification Search
CPC ..... H01P 1/08; H01P 1/042
USPC ..... 333/252, 254
See application file for complete search history.

(56) References Cited

U.S. PATENT DOCUMENTS 2,783,295 A * 2/1957 Ewing ..... H01P 1/042 174/367
2,955,857 A 10/1960 Smith
3,201,296 A 8/1965 Kilduff et al.
3,201,725 A 8/1965 Johnson
D293,575 S 1/1988 Sugiura
D302,159 S 7/1989 Chin
5,024,716 A 6/1991 Sato
(Continued)

FOREIGN PATENT DOCUMENTS

TW D196748 7/2019

OTHER PUBLICATIONS

Search Report for Taiwan Design Application No. 110301737, dated Jun. 27, 2021.

(Continued)

*Primary Examiner* — Benny T Lee
(74) *Attorney, Agent, or Firm* — Moser Taboada

(57) ABSTRACT

Apparatus for transmitting microwaves into a process chamber using a microwave pressure window assembly. The microwave pressure window assembly may include a first plate with a first aperture surrounded by a first recess for a first pressure seal, a second plate with a second aperture surrounded by a second recess for a second pressure seal, a dielectric plate configured to transmit microwaves and interposed between the first plate and the second plate and between the first pressure seal and the second pressure seal. The apertures include a first vertical step area on a first vertical side of the apertures and a second vertical step area on a second vertical side of the apertures opposite of the first vertical side. The first vertical step areas and the second vertical step areas may have a thickness of approximately 50% of a thickness of the plates that includes a dielectric plate recess.

20 Claims, 5 Drawing Sheets

(56) References Cited

U.S. PATENT DOCUMENTS

| | | | | |
|---|---|---|---|---|
| 5,041,804 | A | 8/1991 | Brown | |
| 5,765,835 | A * | 6/1998 | Johnson | F16J 15/064 277/314 |
| 5,936,494 | A * | 8/1999 | Pollock | H01P 1/08 333/252 |
| 6,844,798 | B2 | 1/2005 | Apte et al. | |
| 6,955,287 | B2 | 10/2005 | Horii et al. | |
| 7,012,386 | B1 | 3/2006 | Berg et al. | |
| D571,831 | S | 6/2008 | Ota et al. | |
| D571,833 | S | 6/2008 | Ota et al. | |
| D594,485 | S | 6/2009 | Ota et al. | |
| D606,052 | S | 12/2009 | Noro et al. | |
| D796,491 | S | 9/2017 | Nealis et al. | |
| D872,700 | S | 1/2020 | Karlsson | |
| 10,644,368 | B2 | 5/2020 | Stowell et al. | |
| D908,641 | S | 1/2021 | Roos et al. | |
| 2007/0036895 | A1 | 2/2007 | Carpenter et al. | |
| 2010/0214043 | A1 | 8/2010 | Courtney et al. | |
| 2013/0008607 | A1 | 1/2013 | Matsumoto et al. | |
| 2015/0348757 | A1 | 12/2015 | Stowell et al. | |
| 2019/0157045 | A1 | 5/2019 | Meloni | |
| 2019/0198296 | A1 | 6/2019 | Lu et al. | |

OTHER PUBLICATIONS

PCT International Search Report and Written Opinion for PCT/US2021/056927 dated Feb. 15, 2022.

What are Waveguide Pressure Windows?, everythingRF [online], published Aug. 29, 2019, [retrieved on Feb. 3, 2022]. Retrieved from the Internet, URL: https://www.everythingrf.com/community/what-are-waveguide-pressure-windows.

Pressure Windows, Apollo Microwaves [online], no publication date, [retrieved on Feb. 3, 2022]. Retrieved from the Internet, URL: https://www.apollomw.com/products/?id=262164&product=Waveguide . . . Pressure . . . Windows.

Waveguide Pressure Window, HengDa Microwave [online], no publication date, [retrieved on Feb. 3, 2022]. Retrieved from the Internet, URL: http://m.hengdamw.com/waveguide-components/waveguide-pressure-window-and-flange-shim/waveguide-pressure-window.html.

Waveguide Pressure Windows, MCi Microwave Techniques [online], no publication date, [retrieved on Feb. 3, 2022]. Retrieved from the Internet. URL: https://mcibroadcast.com/waveguide-pressure-windows/.

* cited by examiner

MICROWAVE WINDOW INCLUDING FIRST AND SECOND PLATES WITH VERTICAL STEPPED AREAS CONFIGURED FOR PRESSURE SEALING A DIELECTRIC PLATE BETWEEN THE FIRST AND SECOND PLATES

FIELD

Embodiments of the present principles generally relate to semiconductor processing of semiconductor substrates.

BACKGROUND

Microwaves are used in semiconductor processing to anneal, clean, cure, and degas substrates. The microwaves are typically generated externally from a process chamber and a waveguide is used to transmit the microwaves into a cavity of the process chamber. In general, the process chamber is sealed off from the external environment to control the processing environment's temperature and pressure. A microwave pressure window is used to allow the transmission of the microwaves into the chamber without affecting the pressure or temperature. The inventors have observed, however, that the microwave pressure window when used in high pressure differential environments are prone to failure after a given amount of pressure cycles. In addition, the microwave pressure windows are typically sealed units that must be totally replaced at a substantial cost after a failure occurs.

Accordingly, the inventors have provided improved microwave pressure windows with increased duty cycles and with low replacement costs.

SUMMARY OF THE INVENTION

Methods and apparatus for transmitting microwaves into a cavity with high pressure differentials are provided herein.

In some embodiments, an apparatus for transmitting microwaves may comprise a first plate with a first aperture surrounded by a first recess for a first pressure seal, wherein the first aperture includes a first vertical step area on a first vertical side of the first aperture and a second vertical step area on a second vertical side of the first aperture opposite of the first vertical side, wherein the first vertical step area and the second vertical step area have a thickness of approximately 50% of a thickness of the first plate that includes a dielectric plate recess and wherein the first vertical step area B and the second vertical step area each extends inwards into the first aperture and are configured to reduce reflected power and minimize impedance for microwaves transmitted through the apparatus, a second plate with a second aperture surrounded by a second recess for a second pressure seal, wherein the second aperture includes a third vertical step area on a third vertical side of the second aperture and a fourth vertical step area on a fourth vertical side of the second aperture opposite of the third vertical side, wherein the third vertical step area and the fourth vertical step area have a thickness of approximately 50% of a thickness of the second plate that includes a dielectric plate recess and wherein the third vertical step area and the fourth vertical step area each extends inwards into the second aperture and are configured to reduce reflected power and minimize impedance for microwaves transmitted through the apparatus, and a dielectric plate configured to transmit microwaves and interposed between the first plate and the second plate and between the first pressure seal and the second pressure seal.

In some embodiments, the apparatus may further include wherein the first aperture is approximately 15.8 mm in vertical height and approximately 35 mm in horizontal width excluding the first vertical step area and the second vertical step area, wherein the first vertical step area and the second vertical step area each extends inwards into the first aperture approximately 3 mm to approximately 5 mm, wherein the second aperture is approximately 15.8 mm in vertical height and approximately 35 mm in horizontal width excluding the third vertical step area and the fourth vertical step area, and wherein the third vertical step area and the fourth vertical step area each extends inwards into the second aperture approximately 3 mm to approximately 5 mm, wherein the first plate and the second plate have a plurality of holes for joining the first plate to the second plate spaced approximately 1.5 inches or less apart around a periphery of the first plate and the second plate, wherein the first plate, the second plate, the first pressure seal, the second pressure seal, and the dielectric plate are configured to be joined together with screws placed in the plurality of the holes, wherein the dielectric plate has a thickness of approximately 0.75 mm to approximately 1.25 mm, wherein the dielectric plate is configured to sustain at least approximately 1 atmosphere of differential pressure, wherein the first plate and the second plate are formed from an aluminum-based material or a stainless steel-based material, wherein the apparatus is configured to transmit microwaves from approximately 5.850 GHz to approximately 6.650 GHz with an impedance of less than approximately 50 ohms, wherein the apparatus is configured to permit replacement of the dielectric plate, the first pressure seal, or the second pressure seal by separating the first plate from the second plate after assembly, wherein the dielectric plate is configured to have a duty cycle of greater than 1000 cycles of pressure, and/or wherein the dielectric plate is a quartz-based material.

In some embodiments, an apparatus for transmitting microwaves may comprise a microwave pressure window configured to transmit microwaves from approximately 5.850 GHz to approximately 6.650 GHz with an impedance of less than approximately 50 ohms which may include a first plate with a first aperture surrounded by a first recess for a first O-ring, wherein the first aperture includes a first vertical step area on a first vertical side of the first aperture and a second vertical step area on a second vertical side of the first aperture opposite of the first vertical side, wherein the first aperture is approximately 15.8 mm in vertical height and approximately 35 mm in horizontal width excluding the first vertical step area and the second vertical step area, and wherein the first vertical step area and the second vertical step area have a thickness of approximately 50% a thickness of the first plate B that includes a dielectric plate recess and each extends inwards into the first aperture approximately 3 mm to approximately 5 mm, a second plate with a second aperture surrounded by a second recess for a second O-ring, wherein the second aperture includes a third vertical step area on a third vertical side of the second aperture and a fourth vertical step area on a fourth vertical side of the second aperture opposite of the third vertical side, wherein the second aperture is approximately 15.8 mm in vertical height and approximately 35 mm in horizontal width excluding the third vertical step area and the fourth vertical step area, and wherein the third vertical step area and the fourth vertical step area have a thickness of approximately 50% of a thickness of the second plate that includes a dielectric plate B recess and each extends inwards into the second aperture approximately 3 mm to approximately 5 mm, and a dielectric plate formed of a quartz-based material configured to transmit microwaves and interposed between the first plate and the second plate and between the first O-ring and the second O-ring.

In some embodiments, the apparatus may further include wherein the first plate and the second plate having a plurality of holes for joining the first plate to the second plate spaced approximately 1.5 inches or less apart around a periphery of the first plate and the second plate, wherein the dielectric plate has a thickness of approximately 0.75 mm to approximately 1.25 mm, wherein the dielectric plate is configured to sustain at least approximately 1 atmosphere of differential pressure, wherein the apparatus is configured to permit replacement of the dielectric plate, the first O-ring, or the second O-ring by separating the first plate from the second plate after assembly, and/or wherein the dielectric plate is configured to have a duty cycle of greater than 1000 cycles of pressure.

In some embodiments, an apparatus for transmitting microwaves may comprise a metal plate with an aperture surrounded by a recess for a pressure seal, wherein the aperture is configured to transmit microwaves and includes a first vertical step area on a first vertical side of the aperture and a second vertical step area on a second vertical side of the aperture opposite of the first vertical side, wherein the first vertical step area and the second vertical step area have a thickness of approximately 50% of a thickness of the metal plate that includes a dielectric plate recess and each extends inwards into the aperture and are configured to reduce reflected power and minimize impedance for microwaves transmitted through the apparatus.

In some embodiments, the apparatus may further include wherein the aperture is approximately 15.8 mm in vertical height and approximately 35 mm in horizontal width excluding the first vertical step area and the second vertical step area, wherein the first vertical step area and the second vertical step area each extends inwards into the aperture approximately 3 mm to approximately 5 mm and/or wherein the metal plate is configured to interact with a second plate with a second aperture to hold a dielectric plate interposed between the metal plate and the second plate and between a first pressure seal in the recess of the metal plate and a second pressure seal in a second recess surrounding the second aperture in the second plate, wherein the dielectric plate is configured to provide a pressure window while transmitting microwaves.

Other and further embodiments are disclosed below.

BRIEF DESCRIPTION OF THE DRAWINGS

Embodiments of the present principles, briefly summarized above and discussed in greater detail below, can be understood by reference to the illustrative embodiments of the principles depicted in the appended drawings. However, the appended drawings illustrate only typical embodiments of the principles and are thus not to be considered limiting of scope, for the principles may admit to other equally effective embodiments.

Figure 1:
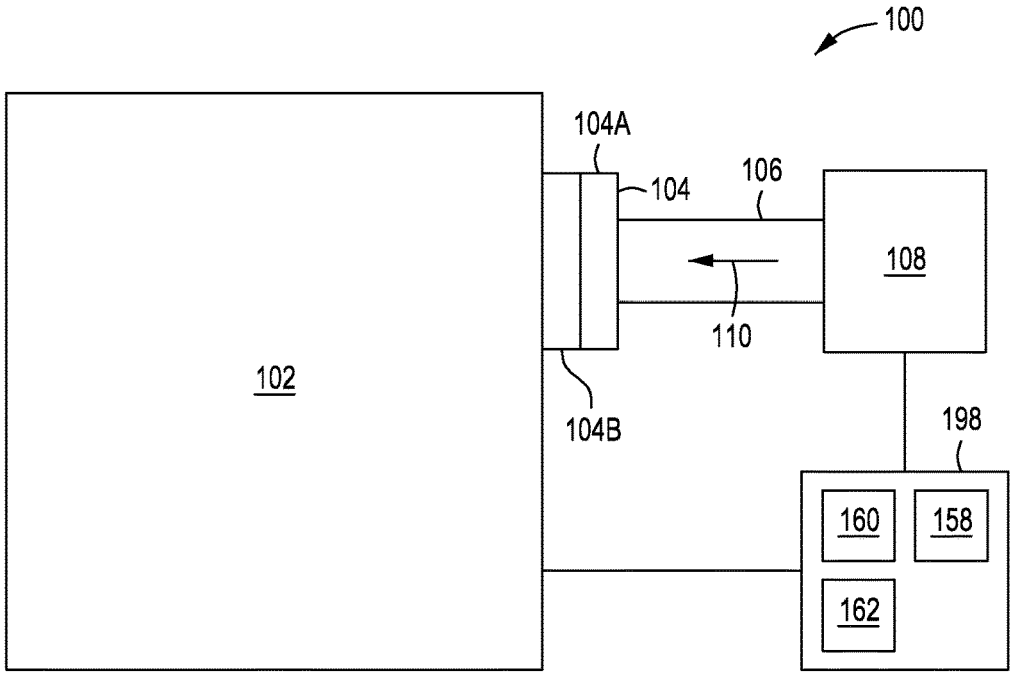
FIG. 1 depicts a cross-sectional view of a process chamber connected to a microwave source in accordance with some embodiments of the present principles.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION OF THE INVENTION

The methods and apparatus provide an increased pressure duty cycle microwave transmission window. The microwave transmission window solves the technical problem of delivering high microwave power into a high vacuum chamber with less reflected power. The microwave transmission window provides the additional benefits of a long life span with easy serviceability and low manufacturing costs. The microwave transmission window is generally composed of four main components, a metal housing comprising two metal plates, a dielectric plate, O-rings, and fastening components such as, for example, screws. The dielectric plate transmits the microwave energy and, at the same time, helps to maintain the vacuum integrity of the process chamber. The dielectric plate is sandwiched between two O-rings and the two metal plates. In some embodiments, the microwave transmission window is assembled using six screws spaced about the dielectric plate.

When microwave energy is transmitted through the dielectric plate, some of the energy will be dissipated inside the dielectric plate. The inventors have found that if the dielectric plate thickness is increased significantly, the energy dissipation in the dielectric plate will increase to a point that the energy dissipation will heat the O-rings and cause the O-rings to disintegrate. The inventors also found that if the thickness of the dielectric plate is decreased significantly, the dielectric plate may break when subjected to differential pressures on the order of negative 15 psi (pounds per square inch). The inventors also found that the spacing or distance between the fastening components such as, for example, screws should be set to prevent microwave leakage from the microwave transmission window. Additionally, the opening in the metal housing should be sized such that the forward and reflected power going in and out of the process chamber is controlled.

FIG. 1 depicts a cross-sectional view 100 of a process chamber 102 connected to a microwave source 108 in accordance with some embodiments. The microwave source 108 is connected to the process chamber 102 via a waveguide 106 that transmits microwave signals 110 into the process chamber 102 through a microwave transmission window 104 attached to the process chamber 102. The microwave transmission window 104 includes a front plate 104A that interfaces with the waveguide 106 and a back plate 104B that interfaces with the process chamber 102. The microwave transmission window 104 also includes the dielectric plate (discussed further below) interposed between the front plate 104A and the back plate 104B to allow the transmission of microwaves through the front plate 104A and the back plate 104B. The front plate 104A and the back olate 104B may be formed from an aluminum-based material or a stainless steel-based material.

A controller 198 controls the operation of the process chamber 102 and/or the microwave source 108 using a direct control of the process chamber 102 and/or the microwave source 108 or alternatively, by controlling the computers (or controllers) associated with the process chamber 102 and/or the microwave source 108. In operation, the controller 198 enables data collection and feedback from the respective chamber and systems to optimize performance of the process chamber 102. The controller 198 generally includes a Central Processing Unit (CPU) 160, a memory 158, and a support circuit 162. The CPU 160 may be any form of a general-purpose computer processor that can be used in an industrial setting. The support circuit 162 is conventionally coupled to the CPU 160 and may comprise a cache, clock circuits, input/output subsystems, power supplies, and the like. Software routines may be stored in the memory 158 and, when executed by the CPU 160, transform the CPU 160 into a specific purpose computer (controller 198). The software routines may also be stored and/or executed by a second controller (not shown) that is located remotely from the process chamber 102.

The memory 158 is in the form of computer-readable storage media that contains instructions, when executed by the CPU 160, to facilitate the operation of the semiconductor processes and equipment. The instructions in the memory 158 are in the form of a program product such as a program that implements the method of the present principles. The program code may conform to any one of a number of different programming languages. In one example, the disclosure may be implemented as a program product stored on a computer-readable storage media for use with a computer system. The program(s) of the program product define functions of the aspects. Illustrative computer-readable storage media include, but are not limited to: non-writable storage media (e.g., read-only memory devices within a computer such as CD-ROM disks readable by a CD-ROM drive, flash memory, ROM chips, or any type of solid-state non-volatile semiconductor memory) on which information is permanently stored; and writable storage media (e.g., floppy disks within a diskette drive or hard-disk drive or any type of solid-state random access semiconductor memory) on which alterable information is stored. Such computer-readable storage media, when carrying computer-readable instructions that direct the functions of the methods described herein, are aspects of the present principles.

Figure 2:
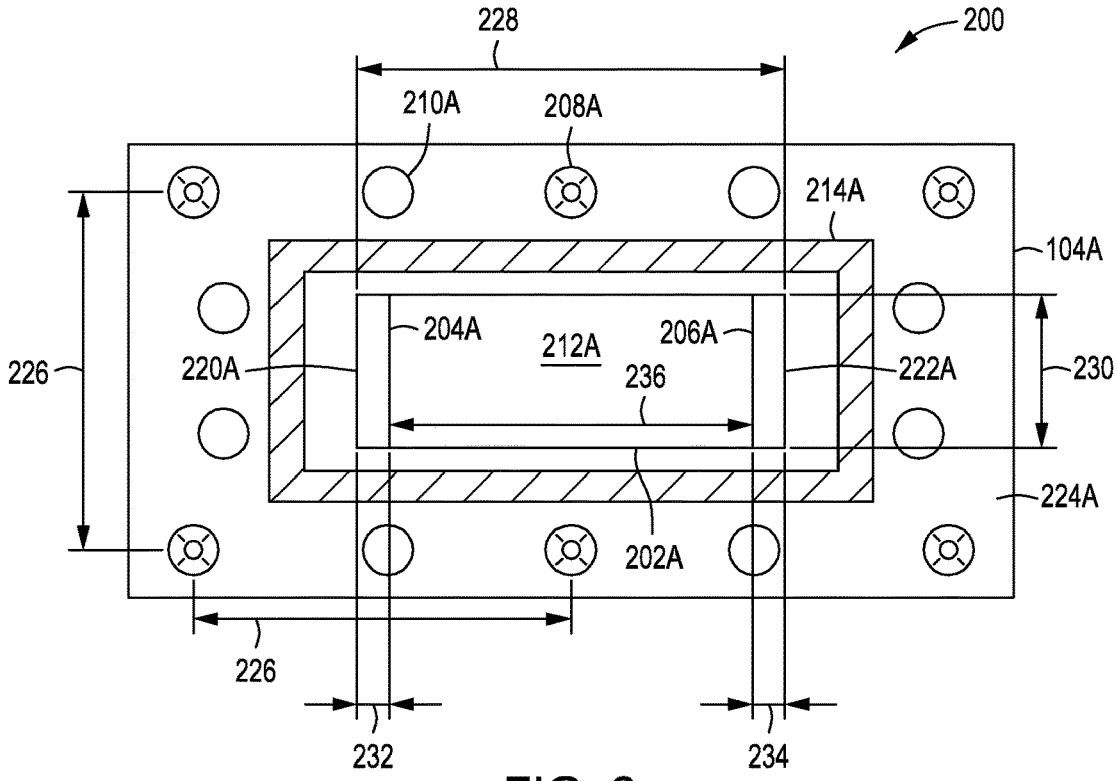
FIG. 2 depicts an exterior view of a front plate of a microwave transmission window in accordance with some embodiments of the present principles.

Although examples illustrated below may apply to a specific frequency or frequencies for the sake of brevity, the present principles may be configured to apply to any frequency or frequencies to reduce reflected power and minimize impedances for microwave transmissions. FIG. 2 depicts an exterior view 200 of the front plate 104A of the microwave transmission window 104 (FIG. 1) in accordance with some embodiments. The exterior view 200 is the side of the front plate 104A that interfaces with a microwave source or waveguide. In some embodiments, the front plate 104A may be formed from a stainless steel material or an aluminum material and the like. The front plate 104A includes a front plate aperture 202A that has a first vertical step area 204A on a first vertical side 220A of the front plate aperture 202A and a second vertical step area 206A on a second vertical side 222A of the front plate aperture 202A. In some embodiments, the front plate aperture 202A has a width 228 of approximately 35.0 mm and a height 230 of approximately 15.8 mm. An approximately 35 mm by approximately 15.8 mm aperture (WR137) allows C-band microwave frequencies (e.g., 5.85 GHz to 6.65 GHz) to be transmitted through the microwave transmission window 104. In some embodiments, the first vertical step area 204A may have a width 232 of approximately 3 mm to approximately 5 mm. In some embodiments, the second vertical step area 206A may have a width 234 of approximately 3 mm to approximately 5 mm. The thicknesses of the first vertical step area 204A and the second vertical step area 206A (described below in FIG. 8) are adjusted to reduce reflected power to a minimum. In some embodiments, the first vertical step area 204A and the second vertical step area 206A may have widths 232, 234 of approximately 4.5 mm. The inventors have found that the approximately 4.5 mm width provides the lowest reflected power and insertion loss with an impedance of approximately 50 ohms for microwave frequencies of approximately 5.85 GHz to approximately 6.65 GHz. The present principles may also be extended to and applied to other examples by extending the first vertical step area 204A and the second vertical step area 206A to reduce the reflected power and minimize the impedance for a given frequency or frequencies.

The front plate aperture 202A has a front plate window area 212A. In some embodiments, the front plate window area 212A may have a width 236 of approximately 25 mm to approximately 29 mm depending on the widths of the first vertical step area 204A and the second vertical step area 206A. The front plate window area 212A acts like a microwave filter that is adjusted by changing the widths of the first vertical step area 204A and the second vertical step area 206A. The front plate aperture 202A is surrounded by a front plate sealing area 214A that is configured to mate with a waveguide connected to a microwave source. A high temperature O-ring is usually placed between the front plate 104A and the waveguide to seal the connection. A plurality of front plate mounting holes 208A surround the front plate sealing area 214A. The plurality of front plate mounting holes 208A are used to connect the front plate 104A to the back plate 104B in FIG. 1. The inventors have observed that if the spacing of the front plate mounting holes 208A are too far apart, microwave leakage will occur between the front plate 104A and the back plate 104B, reducing performance. The inventors have found that if a spacing distance 226 between the front plate mounting holes 208A is approximately 1.5 inches or less, microwave leakage from reflected power between the front plate 104A and the back plate 104B will be reduced to a minimum or prevented completely. The spacing distance 226 is measured from the center points of the front plate mounting holes 208A. In some embodiments, the front plate mounting holes 208A are chamfered into a front surface 224A of the front plate 104A (as shown in FIG. 2). The chamfering allows, for example, a chamfered screw head to be inserted flush with the front surface 224A of the front plate 104A. In some embodiments, the front plate mounting holes 208A may be stepped (not shown) (larger initial hole size that steps to the smaller through hole size) in order to accept a screw head to make the top of the screw head flush with the front surface 224A.

Figure 3:
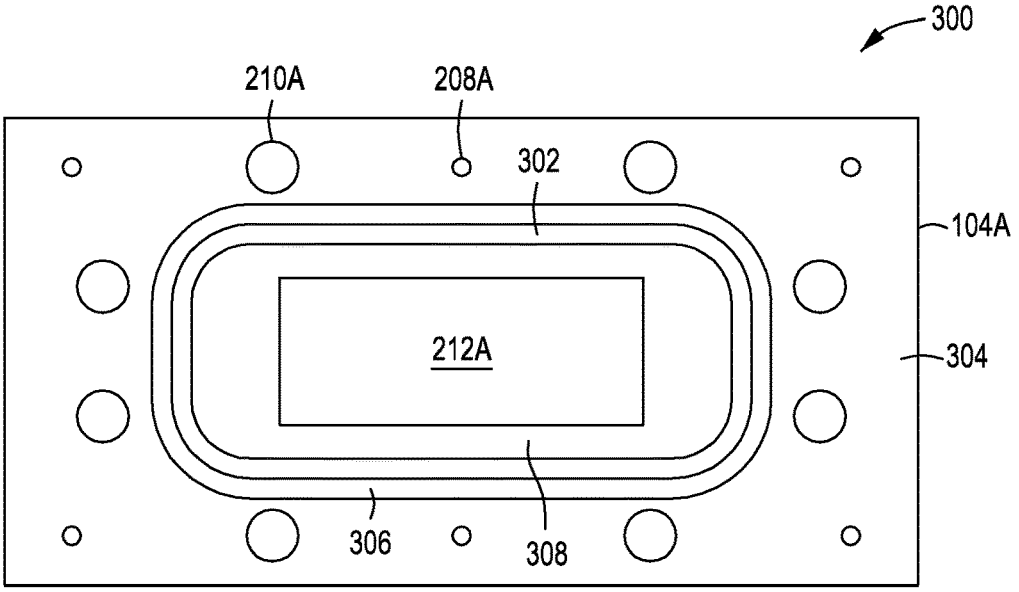
FIG. 3 depicts an interior view of a front plate of a microwave transmission window in accordance with some embodiments of the present principles.

A plurality of through holes 210A surround the front plate sealing area 214A to provide mounting of the microwave transmission window 104 to the process chamber 102 in FIG. 1. The front plate sealing area 214A may be a flat area with or without a highly polished surface to minimize microwave leakage between the front plate 104A and a microwave source or waveguide. FIG. 3 depicts an interior view 300 of the front plate 104A of the microwave transmission window 104 (FIG. 1) in accordance with some embodiments. A back surface 304 includes a first recessed channel 302 to allow a first O-ring to be used to seal the front plate 104A to a first side of a dielectric plate (discussed below) around the perimeter of the front plate window area 212A. The first recessed channel 302 may have a depth of approximately 1.5 mm to approximately 2 mm. The front plate 104A also has dielectric plate recesses 306, 308 with a depth of approximately one half of the thickness of a dielectric plate (see FIG. 8 below) to allow the front plate 104A and the back plate 104B in FIG. 1 to accommodate the dielectric plate when clamped together. The dielectric plate recesses 306, 308 have a depth that is less than the depth of the first recessed channel 302. The front plate mounting holes 208A are not chamfered or stepped on the back surface 304 of the front plate 104A.

Figure 4:
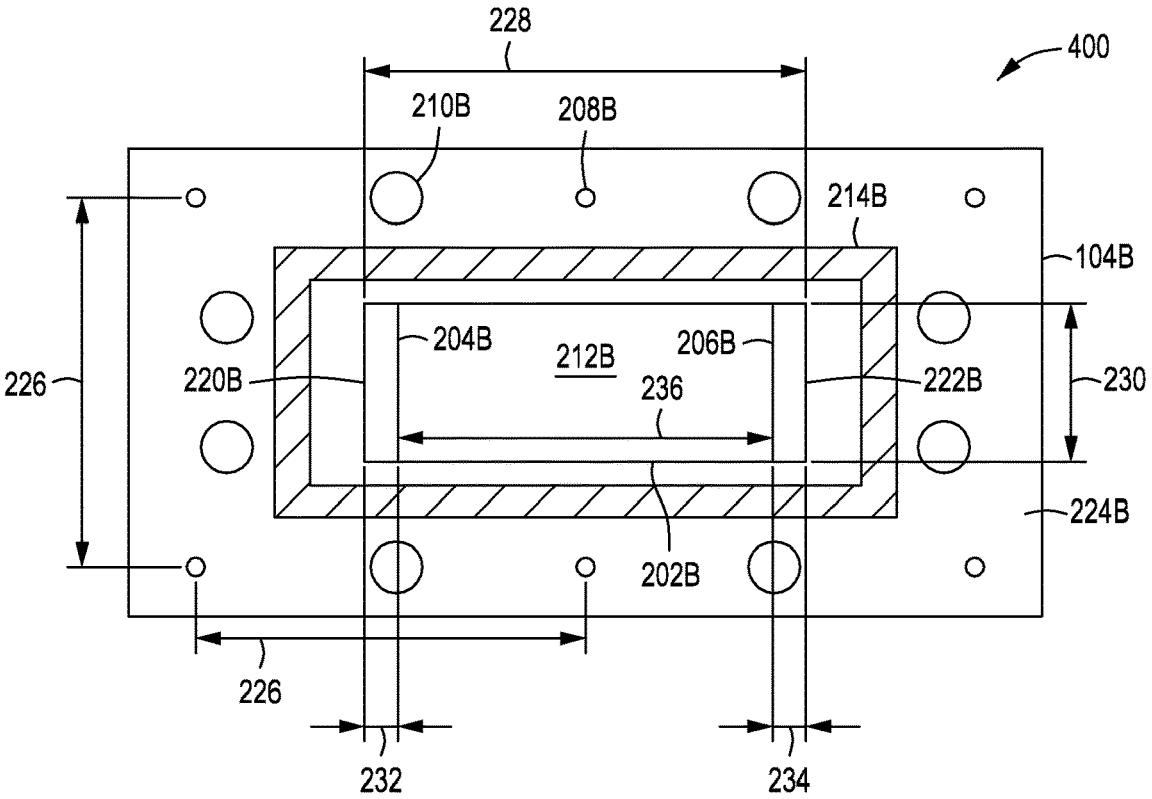
FIG. 4 depicts an exterior view of a back plate of a microwave transmission window in accordance with some embodiments of the present principles.

FIG. 4 depicts an exterior view 400 of the back plate 104B of the microwave transmission window 104 (FIG. 1) in accordance with some embodiments. The exterior view 400 is the side of the back plate 104B that interfaces with a process chamber. In some embodiments, the back plate 104B may be formed from a stainless steel material or an aluminum material and the like. The back plate 104B includes a back plate aperture 202B that has a first vertical step area 204B on a first vertical side 220B of the back plate aperture 202B and a second vertical step area 206B on a second vertical side 222B of the back plate aperture 202B. In some embodiments, the back plate aperture 202B has a width 228 of approximately 35.0 mm and a height 230 of approximately 15.8 mm. An approximately 35 mm by approximately 15.8 mm aperture (WR137) allows C-band microwave frequencies (e.g., 5.85 GHz to 6.65 GHz) to be transmitted through the microwave transmission window 104. In some embodiments, the first vertical step area 204B may have a width 232 of approximately 3 mm to approximately 5 mm. In some embodiments, the second vertical step area 206B may have a width 234 of approximately 3 mm to approximately 5 mm. The thicknesses of the first vertical step area 204B and the second vertical step area 206B (described below in FIG. 8) are adjusted to reduce reflected power to a minimum. In some embodiments, the first vertical step area 204B and the second vertical step area 206B may have widths 232, 234 of approximately 4.5 mm. The inventors have found that the approximately 4.5 mm width provides the lowest reflected power and insertion loss with an impedance of approximately 50 ohms for microwave frequencies of approximately 5.85 GHz to approximately 6.65 GHz. The present principles may also be extended to and applied to other examples by extending the first vertical step area 204B and the second vertical step area 206B to reduce the reflected power and minimize the impedance for a given frequency or frequencies.

The back plate aperture 202B has a back plate window area 212B. In some embodiments, the back plate window area 212B may have a width 236 of approximately 25 mm to approximately 29 mm depending on the widths of the first vertical step area 204B and the second vertical step area 206B. The back plate window area 212B acts like a microwave filter that is adjusted by changing the widths of the first vertical step area 204B and the second vertical step area 206B. The back plate aperture 202B is surrounded by a back plate sealing area 214B on a front surface 224B of the back plate 104B that is configured to mate with a process chamber. A high temperature O-ring is usually placed between the back plate 104B and the process chamber to seal the connection. A plurality of back plate mounting holes 208B surround the back plate sealing area 214B. The plurality of back plate mounting holes 208B are used to connect the front plate 104A (FIG. 2) to the back plate 104B. As noted above for the front plate mounting holes 208A, if the spacing distance 226 between the back plate mounting holes 208B is approximately 1.5 inches or less, microwave leakage from reflected power between the front plate 104A and the back plate 104B will be reduced to a minimum or prevented completely. The spacing distance 226 is measured from the center points of the back plate mounting holes 208B. In some embodiments, the back plate mounting holes 208B are threaded to accept a screw that extends through the front plate mounting holes 208A (FIG. 3) with the threads of the screw threading into the back plate mounting holes 208B to provide a clamping force between the front plate 104A and the back plate 104B.

Figure 5:
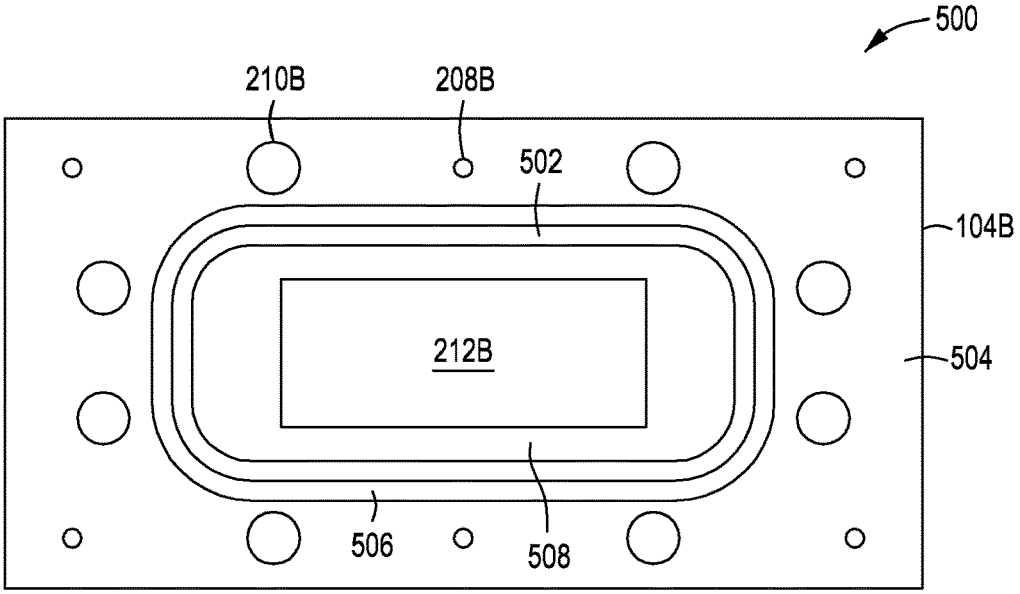
FIG. 5 depicts an interior view of a back plate of a microwave transmission window in accordance with some embodiments of the present principles.

A plurality of through holes 210B surround the back plate sealing area 214B to provide mounting of the microwave transmission window 104 to the process chamber 102 in FIG. 1. The back plate sealing area 214B may be a flat area with or without a highly polished surface to minimize microwave leakage between the back plate 104B in FIG. 1 and a process chamber. FIG. 5 depicts an interior view 500 of the back plate 104B of the microwave transmission window 104 (FIG. 1) in accordance with some embodiments. A back surface 504 includes a second recessed channel 502 to allow a second O-ring to be used to seal the back plate 104B to a second side of a dielectric plate (discussed below) around the perimeter of the back plate window area 212B. The second recessed channel 502 may have a depth of approximately 1.5 mm to approximately 2 mm. The back plate 104B also has dielectric plate recesses 506, 508 with a depth of approximately one half of the thickness of a dielectric plate (see FIG. 8 below) to allow the front plate 104A (FIG. 2) and the back plate 104B to accommodate the dielectric plate when clamped together. The dielectric plate recesses 506, 508 have a depth that is less than the depth of the second recessed channel 502.

Figure 6:
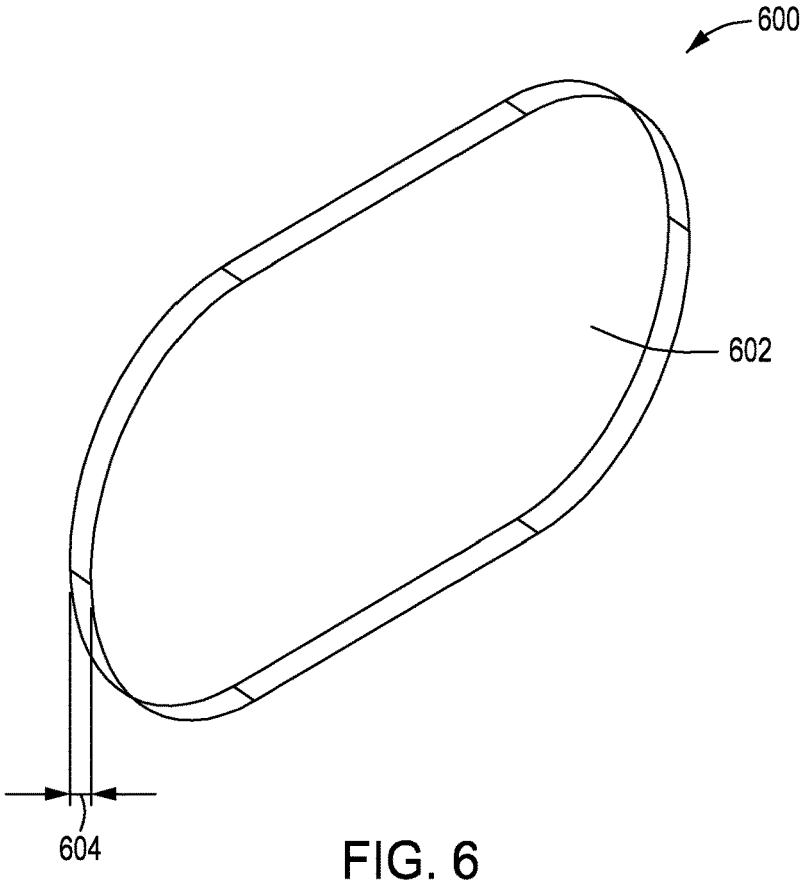
FIG. 6 depicts an isometric view of a dielectric plate in accordance with some embodiments of the present principles.

FIG. 6 depicts an isometric view 600 of a dielectric plate 602 in accordance with some embodiments. The dielectric plate 602 is made of a material that is transparent to microwaves (is not extensively heated when exposed to microwaves). In some embodiments, the dielectric plate 602 may be, as a non-limiting example, composed of quartz and the like. The inventors have observed that if the dielectric plate 602 is too thin, the dielectric plate 602 will fail frequently when used with high vacuum pressure process chambers due to the large pressure differentials (one side of the dielectric plate is at a vacuum (chamber cavity) and at atmosphere on the opposite side of the dielectric plate (waveguide)). In some instances, the dielectric plate 602 is exposed to close to one atmosphere of pressure difference. The inventors have also observed that if the dielectric plate 602 is too thick, the microwaves traveling through the dielectric plate 602 will begin to heat the dielectric plate 602 causing failures and losses. The inventors have found that when using a quartz material for the dielectric plate 602, a thickness 604 of approximately 0.75 mm to approximately 1.25 mm provides a thickness that is robust enough to withstand high pressure differentials while minimizing internal heating of the quartz material. Thicker material is able to withstand higher pressure differentials but also has higher insertion losses than thinner materials. Selection of the thickness should be performed in light of the pressure differentials the dielectric plate 602 will be exposed to ensure long life while keeping insertion losses at a minimum. The outer shape of the dielectric plate 602 is arbitrary as long as the shape is sufficient to cover the transmission window opening and provide an adequate microwave seal against the first O-ring 702 (FIG. 7) and the second O-ring 704 (FIG. 7) when clamped between the front plate 104A and the back plate 104B.

Figure 7:
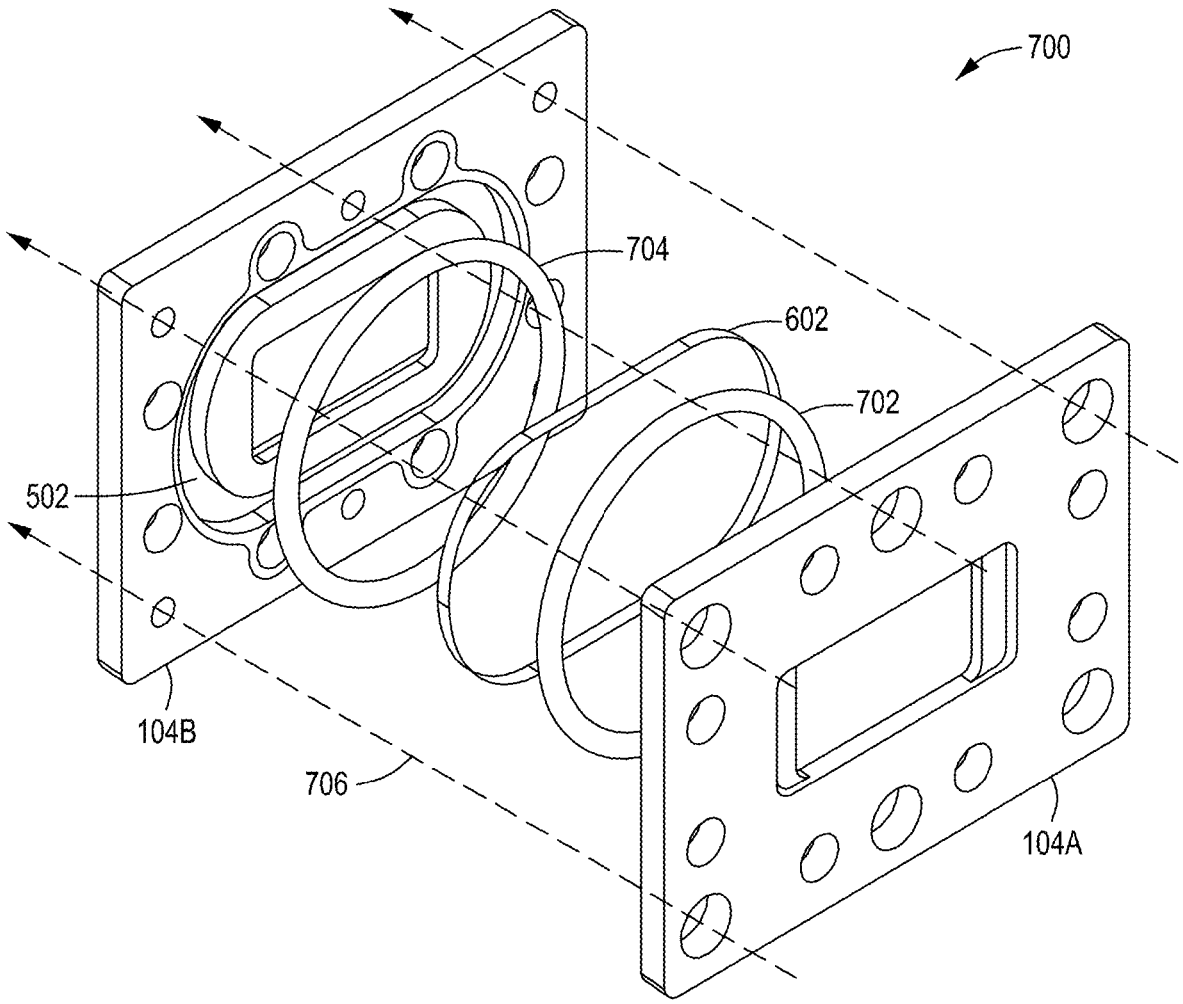
FIG. 7 depicts an exploded isometric view of a microwave transmission window assembly in accordance with some embodiments of the present principles.

FIG. 7 depicts an exploded isometric view of a microwave transmission window assembly 700 in accordance with some embodiments. The microwave transmission window assembly 700 includes the front plate 104A and the back plate 104B with the dielectric plate 602 interposed between the first O-ring 702 and the second O-ring 704 and the front plate 104A and the back plate 104B. The first O-ring 702 and the second O-ring 704 may be formed from a conductive or non-conductive material that remains pliable at high temperatures. The deformation percentage of the O-ring is related to the hardness of the O-ring material. In some embodiments, the O-ring material may have a Shore A durometer hardness of approximately 75 which has a compression or deformation range of approximately 20 percent to approximately 30 percent. The thickness of the first O-ring is greater than a depth of the recessed channel 302 of the front plate 104A (see FIG. 3 and FIG. 7) and may have a thickness of approximately 1.5 mm to approximately 2 mm. The thickness of the second O-ring is greater than a depth of the recessed channel 502 of the back plate 104B (see FIG. 5 and FIG. 7) and may have a thickness of approximately 1.5 mm to approximately 2 mm. The arrows 706 represent the direction in which the screws are inserted to join the microwave transmission window assembly 700 together. As discussed above, in some embodiments, the screws are inserted through the front plate 104A into a chamfered hole and threaded into a hole in the back plate 104B to provide a clamping force to hold the dielectric plate 602, the first O-ring 702, and the second O-ring 704 between the front plate 104A and the back plate 104B. The tightening force applied to the screws is sufficient enough to compress the O-rings and seal the dielectric plate 602 such that microwave leakage is substantially reduced or eliminated. One advantage of the microwave transmission window assembly 700 is that the microwave transmission window assembly 700 is easily serviced by removing the screws and replacing any of the parts (e.g., O-rings, front plate, back plate, dielectric plate, etc.), eliminating any need to replace the entire microwave transmission window assembly 700, reducing ownership costs of the microwave transmission window assembly 700 over a lifetime.

Figure 8:
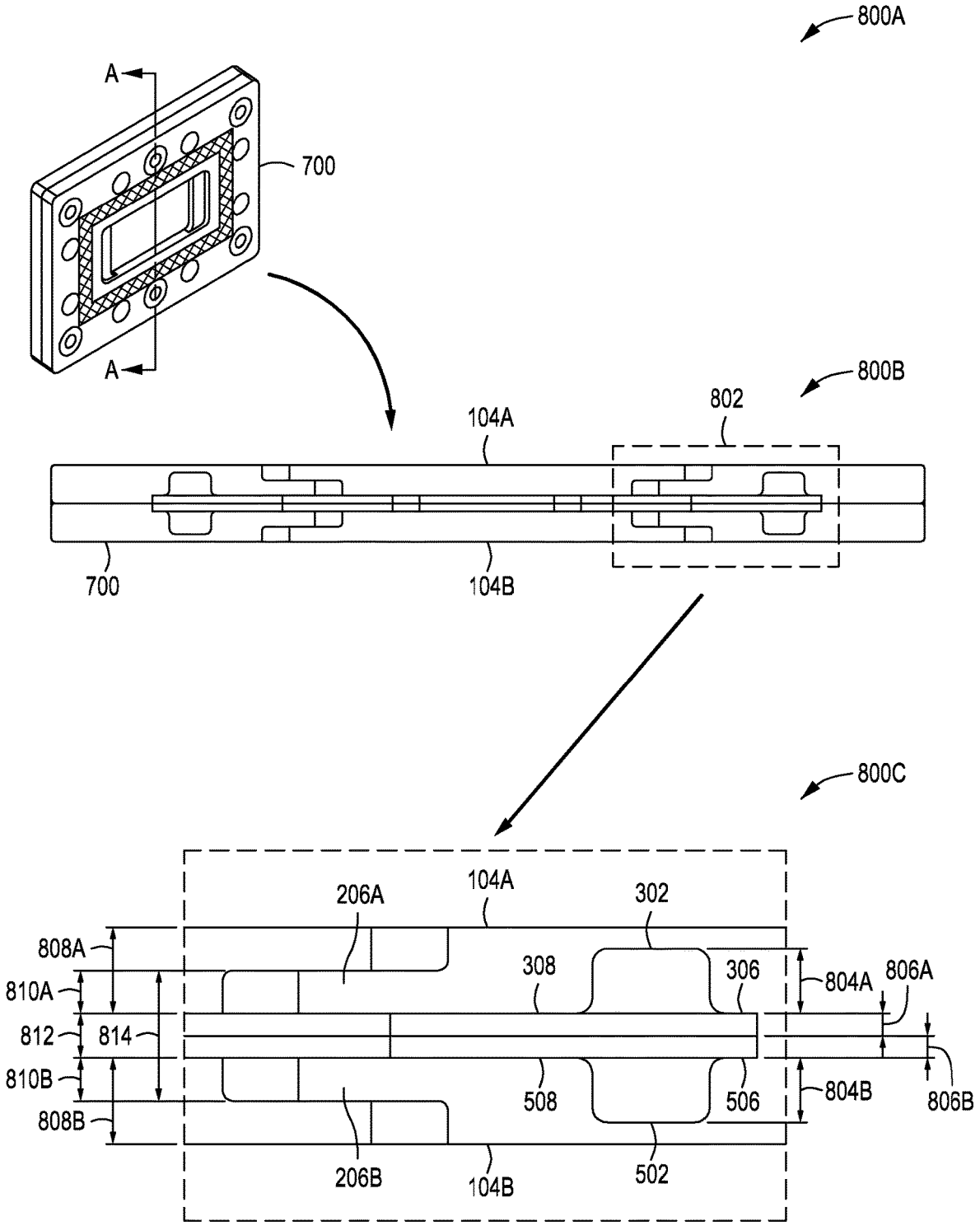
FIG. 8 depicts views of a microwave transmission window in accordance with some embodiments of the present principles.

FIG. 8 depicts views of a microwave transmission window assembly 700 in accordance with some embodiments. In an isometric view 800A, the microwave transmission window assembly 700 is shown assembled and depicted with a cross-sectional line A-A. A cross-sectional line A-A view 800B shows a right side portion 802 that is enlarged in a cross-sectional view 800C. The dimensions of the right side portion are mirrored on the left side of the microwave transmission window assembly 700. The cross-sectional view 800C illustrates several dimensions that are used in some embodiments. The second vertical step area 206A of the front plate 104A has a thickness 810A of approximately one half of a thickness 808A of the front plate 104A in the area with accommodations for the thickness of the dielectric plate. In some embodiments, the thickness 810A is 1.96 mm+/−10%. In some embodiments, the dielectric plate thickness is approximately 0.75 mm to approximately 1.25 mm as is a thickness 812. The thicknesses of the first vertical step area and the second vertical step area of the front plate 104A provide optimum performance when the thicknesses are 50% of the front plate thickness in the area accommodating the dielectric plate (50% of the thickness 808A).

The second vertical step area 206B of the back plate 1048 has a thickness 810B of approximately one half of a thickness 808B of the back plate 104B in the area with accommodations for the thickness of the dielectric plate. In some embodiments, the dielectric plate thickness is approximately 0.75 mm to approximately 1.25 mm as is the thickness 812. In some embodiments, the thickness 810B is 1.96 mm+/−10%. The thicknesses of the first vertical step area and the second vertical step area of the back plate 104B provide optimum performance when the thicknesses are 50% of the back plate thickness in the area accommodating the dielectric plate (50% of the thickness 8088). In some embodiments, a total thickness 814 that includes the step areas of the front and back plates along with the dielectric plate thickness is 4.93 mm+/−10%. The total thickness 814 influences the microwave transmission with respect to reflected power.

The dielectric plate recesses 306, 308 of the front plate 104A have a depth 806A of approximately one half of the thickness 812 of the dielectric plate. The dielectric plate recesses 506, 508 of the back plate 104B have a depth 806B of approximately one half of the thickness 812 of the dielectric plate. The first recessed channel 302 of the front plate 104A has a depth 804A of approximately 1.5 mm to approximately 2 mm to accommodate the first O-ring 702 in FIG. 7. The second recessed channel 502 of the back plate 104B has a depth 804B of approximately 1.5 mm to approximately 2 mm to accommodate the second O-ring 704 in FIG. 7.

Embodiments in accordance with the present principles may be implemented in hardware, firmware, software, or any combination thereof. Embodiments may also be implemented as instructions stored using one or more computer readable media, which may be read and executed by one or more processors. A computer readable medium may include any mechanism for storing or transmitting information in a form readable by a machine (e.g., a computing platform or a "virtual machine" running on one or more computing platforms). For example, a computer readable medium may include any suitable form of volatile or non-volatile memory. In some embodiments, the computer readable media may include a non-transitory computer readable medium.

While the foregoing is directed to embodiments of the present principles, other and further embodiments of the principles may be devised without departing from the basic scope thereof.

The invention claimed is:

1. An apparatus for transmitting microwaves, comprising:

a first plate with a first aperture surrounded by a first recess for a first pressure seal, wherein the first aperture includes a first vertical step area on a first vertical side of the first aperture and a second vertical step area on a second vertical side of the first aperture opposite of the first vertical side, wherein the first vertical step area and the second vertical step area have a thickness of approximately 50% of a thickness of the first plate that includes a dielectric plate recess and wherein the first vertical step area and the second vertical step area each extends inwards into the first aperture and are configured to reduce reflected power and minimize impedance for microwaves transmitted through the apparatus;

a second plate with a second aperture surrounded by a second recess for a second pressure seal, wherein the second aperture includes a third vertical step area on a third vertical side of the second aperture and a fourth vertical step area on a fourth vertical side of the second aperture opposite of the third vertical side, wherein the third vertical step area and the fourth vertical step area have a thickness of approximately 50% of a thickness of the second plate that includes a dielectric plate recess and wherein the third vertical step area and the fourth vertical step area each extends inwards into the second aperture and are configured to reduce reflected power and minimize impedance for microwaves transmitted through the apparatus; and a dielectric plate configured to transmit microwaves and interposed between the first plate and the second plate and between the first pressure seal and the second pressure seal.

2. The apparatus of claim 1, wherein the first aperture is approximately 15.8 mm in vertical height and approximately 35 mm in horizontal width excluding the first vertical step area and the second vertical step area, wherein the first vertical step area and the second vertical step area each extends inwards into the first aperture approximately 3 mm to approximately 5 mm, wherein the second aperture is approximately 15.8 mm in vertical height and approximately 35 mm in horizontal width excluding the third vertical step area and the fourth vertical step area, and wherein the third vertical step area and the fourth vertical step area each extends inwards into the second aperture approximately 3 mm to approximately 5 mm.

3. The apparatus of claim 1, wherein the first plate and the second plate have a plurality of holes for joining the first plate to the second plate spaced approximately 1.5 inches or less apart around a periphery of the first plate and the second plate.

4. The apparatus of claim 3, wherein the first plate, the second plate, the first pressure seal, the second pressure seal, and the dielectric plate are configured to be joined together with screws placed in the plurality of the holes.

5. The apparatus of claim 1, wherein the dielectric plate has a thickness of approximately 0.75 mm to approximately 1.25 mm.

6. The apparatus of claim 1, wherein the dielectric plate is configured to sustain at least approximately 1 atmosphere of differential pressure.

7. The apparatus of claim 1, wherein the first plate and the second plate are formed from an aluminum-based material or a stainless steel-based material.

8. The apparatus of claim 1, wherein the apparatus is configured to transmit microwaves from approximately 5.850 GHz to approximately 6.650 GHz with an impedance of less than approximately 50 ohms.

9. The apparatus of claim 1, wherein the apparatus is configured to permit replacement of the dielectric plate, the first pressure seal, or the second pressure seal by separating the first plate from the second plate after assembly.

10. The apparatus of claim 1, wherein the dielectric plate is configured to have a duty cycle of greater than 1000 cycles of pressure.

11. The apparatus of claim 1, wherein the dielectric plate is a quartz-based material.

12. An apparatus for transmitting microwaves, comprising:

a microwave pressure window configured to transmit microwaves from approximately 5.850 GHz to approximately 6.650 GHz with an impedance of less than approximately 50 ohms including:

a first plate with a first aperture surrounded by a first recess for receiving a first O-ring therein, wherein the first aperture includes a first vertical step area on a first vertical side of the first aperture and a second vertical step area on a second vertical side of the first aperture opposite of the first vertical side, wherein the first aperture is approximately 15.8 mm in vertical height and approximately 35 mm in horizontal width excluding the first vertical step area and the second vertical step area, and wherein the first vertical step area and the second vertical step area have a thickness of approximately 50% a thickness of the first plate that includes a dielectric plate recess and wherein the first vertical step area and the second vertical step area each extends inwards into the first aperture approximately 3 mm to approximately 5 mm;

a second plate with a second aperture surrounded by a second recess for receiving a second O-ring therein, wherein the second aperture includes a third vertical step area on a third vertical side of the second aperture and a fourth vertical step area on a fourth vertical side of the second aperture opposite of the third vertical side, wherein the second aperture is approximately 15.8 mm in vertical height and approximately 35 mm in horizontal width excluding the third vertical step area and the fourth vertical step area, and wherein the third vertical step area and the fourth vertical step area have a thickness of approximately 50% of a thickness of the second plate that includes a dielectric plate recess and wherein the third vertical step area and the fourth vertical step area each extends inwards into the second aperture approximately 3 mm to approximately 5 mm; and a dielectric plate formed of a quartz-based material configured to transmit microwaves and interposed between the first plate and the second plate and between the first O-ring and the second O-ring.

13. The apparatus of claim 12, wherein the first plate and the second plate having a plurality of holes for joining the first plate to the second plate spaced approximately 1.5 inches or less apart around a periphery of the first plate and the second plate.

14. The apparatus of claim 12, wherein the dielectric plate has a thickness of approximately 0.75 mm to approximately 1.25 mm.

15. The apparatus of claim 12, wherein the dielectric plate is configured to sustain at least approximately 1 atmosphere of differential pressure.

16. The apparatus of claim 12, wherein the apparatus is configured to permit replacement of the dielectric plate, the first O-ring, or the second O-ring by separating the first plate from the second plate after assembly.

17. The apparatus of claim 12, wherein the dielectric plate is configured to have a duty cycle of greater than 1000 cycles of pressure.

18. An apparatus for transmitting microwaves, comprising:

a metal plate with an aperture surrounded by a recess for receiving a fir pressure seal therein, wherein the aperture is configured to transmit microwaves and includes a first vertical step area on a first vertical side of the aperture and a second vertical step area on a second vertical side of the aperture opposite of the first vertical side, wherein the first vertical step area and the second vertical step area have a thickness of approximately 50% of a thickness of the metal plate that includes a dielectric plate recess and wherein the first vertical step area and the second vertical step area each extends inwards into the aperture and are configured to reduce reflected power and minimize impedance for microwaves transmitted through the apparatus.

19. The apparatus of claim 18, wherein the aperture is approximately 15.8 mm in vertical height and approximately 35 mm in horizontal width excluding the first vertical step area and the second vertical step area, wherein the first vertical step area and the second vertical step area each extends inwards into the aperture approximately 3 mm to approximately 5 mm.

20. The apparatus of claim 18, wherein the metal plate is configured to interact with a second plate with a second aperture to hold a dielectric plate interposed between the metal plate and the second plate and between h first pressure seal received in the recess of the metal plate and a second pressure seal received in a second recess surrounding the second aperture in the second plate, wherein the dielectric plate is configured to provide a pressure window while transmitting microwaves.

* * * * *